US005800144A

United States Patent [19]

Glenn et al.

[11] Patent Number: 5,800,144

[45] Date of Patent: Sep. 1, 1998

[54] APPLICATOR CONTAINER

[75] Inventors: William C. Glenn, Alpharetta; Joseph H. Workman, LaGrange, both of Ga.

[73] Assignee: OSI Sealants, Inc., Mentor, Ohio

[21] Appl. No.: 819,364

[22] Filed: Mar. 17, 1997

Related U.S. Application Data

[63] Continuation of Ser. No. 512,890, Aug. 9, 1995, abandoned.

[51] Int. Cl.[6] ..... B05C 17/00

[52] U.S. Cl. ..... 401/139; 15/236.02; 220/608; 401/266

[58] Field of Search ..... 401/139, 266, 401/123, 124; 15/236.02; 220/600, 608; 222/107, 215

[56] References Cited

U.S. PATENT DOCUMENTS 2,770,826 11/1956 Curfman ..... 401/139
3,011,499 12/1961 Tajan ..... 401/139
4,261,482 4/1981 Yamada et al. ..... 222/215
5,246,122 9/1993 Schick et al. ..... 220/608 X

FOREIGN PATENT DOCUMENTS 3519321 12/1986 Germany ..... 401/139

*Primary Examiner*—Steven A. Bratlie
*Attorney, Agent, or Firm*—Law Office of Victor E. Libert; Victor E. Libert; Frederick A. Spaeth

[57] ABSTRACT

The applicator-container (10) has an interior (14) within which a flowable paste material such as a caulking compound, a sealing compound, putty or the like may be contained. A threaded cap (34) is used to selectively open or close container mouth (16). One end of applicator-container (10) is tapered to provide a smooth applicator blade surface (28) which terminates in a straight edge (30). Applicator blade surface (28) and straight edge 30 simulate the configuration of a conventional putty knife and may be used to shape and smooth a flowable paste material dispensed from the applicator-container (10).

11 Claims, 2 Drawing Sheets

FIG. 1B
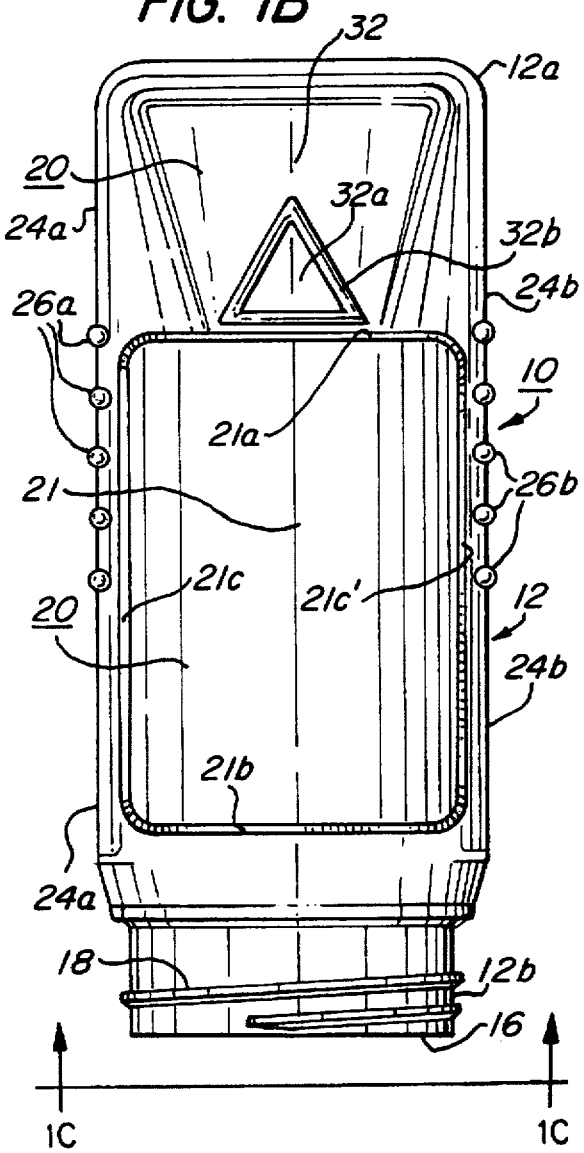
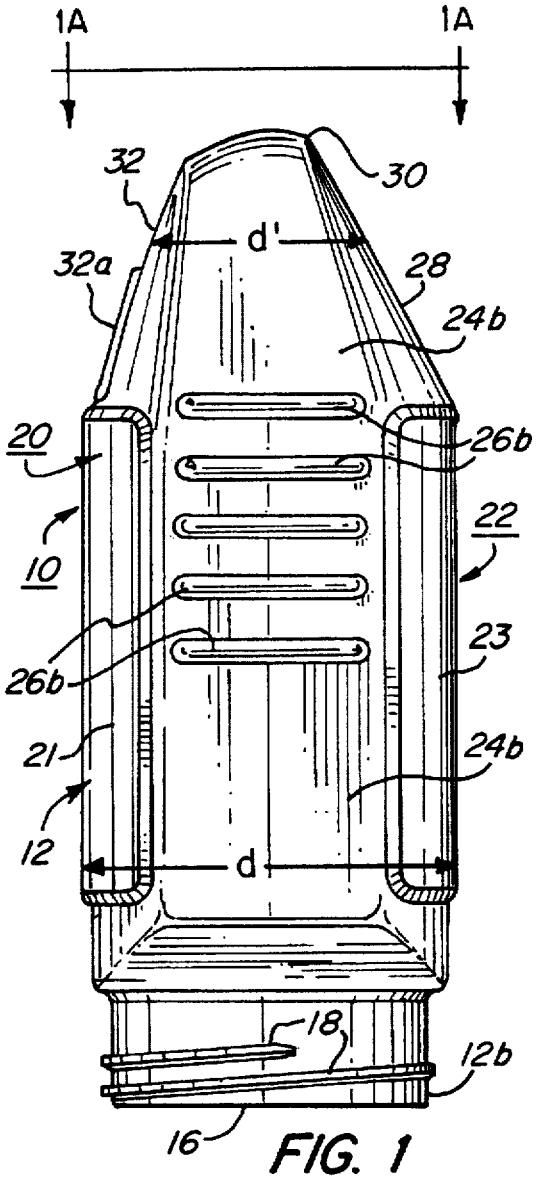
FIG. 1
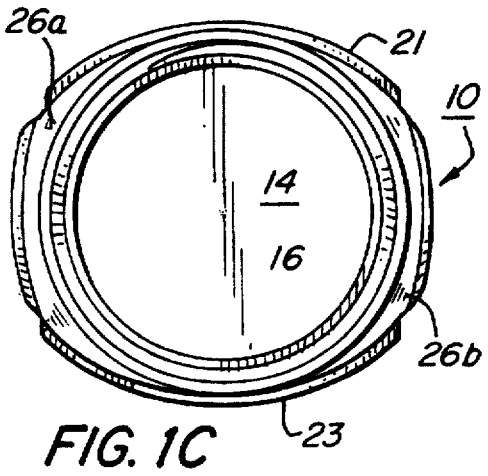
FIG. 1C
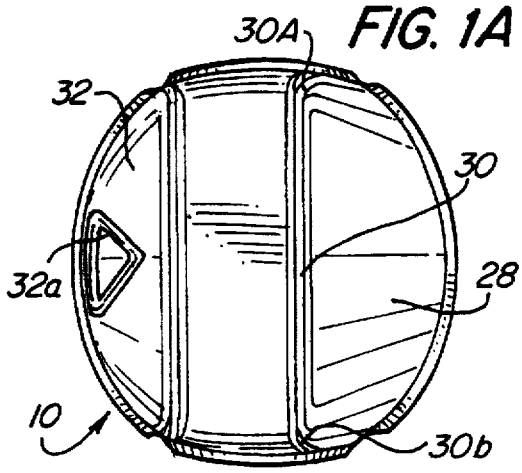
FIG. 1A

APPLICATOR CONTAINER

This application is a continuation of application Ser. No. 08/512,890 filed on Aug. 9, 1995 now abandoned.

BACKGROUND OF THE INVENTION

1. Field of the Invention

The present invention relates to containers for flowable paste materials such as caulking compounds, sealing compounds, patching compounds and the like, and more particularly to such containers which have thereon an applicator means for working and smoothing the paste material dispensed from the container.

2. Related Art

The provision of containers, usually made from a synthetic polymeric material (plastic) for containing and dispensing flowable paste materials such as caulking, sealing and patching compounds is well-known in the art. It is known to provide such containers made of a suitable plastic material and otherwise configured so that the container is "squeezable" to facilitate dispensing the flowable paste material, which normally has a viscous, paste-like consistency, from the container. It is also known to provide a closure means for the container, such as a screw-on cap, which is configured in the manner of a putty knife. Thus, one commercially available product comprises a cylindrical container having a mouth at one end and containing a flowable paste material, the mouth being selectively closable by a screw-on cap from which there projects, substantially along the vertical axis of the cylindrical container, an integrally-molded, plastic putty knife. In use, the cap is removed from the mouth of the container, the flowable paste material is dispensed onto the surface or workpiece to which the material is to be applied, and the integrally-molded putty knife blade is used to apply and smooth the material. The closure means is conveniently reapplied to the container mouth before using the blade, so that the cylindrical container itself serves as a handle for manipulating the blade.

There is also commercially available a plastic container for a flowable paste material which has a first end and an opposite, second end, and has a mouth at the second end. The mouth is sealable by a screw-on threaded cap which has a flat crown. The first end of the container tapers to a wedge-like configuration with the distal edge of the wedge being rounded as seen in front and rear view, so that the container cannot stand vertically upon its first end (the end opposite the closure mouth) without toppling over. If the container is to be stored vertically, it must be stored with the mouth side down so that the flat crown of the cap serves as a base to support the container in a vertical position. By storing the container in such manner, gravity will pull the flowable paste material to the second (closure mouth end) of the container, where it is ready for immediate dispensing from the container.

SUMMARY OF THE INVENTION

Generally, the present invention provides an applicator-container having a tapered end which is dimensioned and configured on at least one side thereof generally in the shape of a putty knife to provide an applicator means. The applicator-container will in use contain a flowable paste material such as putty, a caulking compound, etc., and the applicator means is used to smooth and spread the material in the way one would employ a putty knife for the purpose.

Specifically, in accordance with the present invention there is provided an applicator-container comprising the following elements. A container body defines an interior for containing a flowable paste material and has a container mouth formed therein. Seating means are provided on the applicator-container and are dimensioned and configured to receive a closure means for selectively (a) closing the container mouth to seal the interior and (b) opening the container mouth to enable dispensing such flowable material therethrough. An applicator means, which optionally may be integrally formed as part of the container body, is carried on the container independently of such closure means and comprises an applicator blade surface which terminates in a straight edge.

In one aspect of the present invention the container body has opposite first and second ends and the applicator means is at the first end and the container mouth is at the second end.

Another aspect of the present invention includes the closure means seated on the seating means to close the container mouth. For example, in one embodiment the seating means comprises a thread structure disposed adjacent the container mouth and the closure means comprises a threaded cap.

Yet another aspect of the present invention provides for the container body to have a front face and a rear face with the front and rear faces being separated by a pair of opposite side panels, so that the container body has a depth defined by the shortest straight line distance between the front face and the rear face. The container body further has respective first and second ends and a rear tapered portion which extends along at least a part of the rear face and reduces the depth of the container body as sensed moving along the container body towards the first end, the rear tapered portion comprising the applicator means and terminating in the applicator straight edge.

Another aspect of the present invention provides on the container body a front tapered portion which extends along at least a part of the front face and cooperates with the rear tapered portion to reduce the depth of the container body as sensed moving along the container body towards the first end.

Other aspects of the present invention provide for one or more of the following features, alone or in combination: a finger rest formed on the tapered portion of the first face; grip-enhancing formations formed on the side panels; and the applicator blade surface comprises a smooth surface which terminates in the straight edge.

BRIEF DESCRIPTION OF THE DRAWINGS

FIG. 1 is a side view of an applicator-container comprising one embodiment of the present invention;

FIG. 1A is a top view taken along line 1A—1A of FIG. 1;

FIG. 1B is an elevation front view of the applicator-container of FIG. 1;

FIG. 1C is a bottom view taken along line 1C—1C of FIG. 1B;

DETAILED DESCRIPTION OF THE INVENTION AND SPECIFIC EMBODIMENTS THEREOF

Figure 1D:
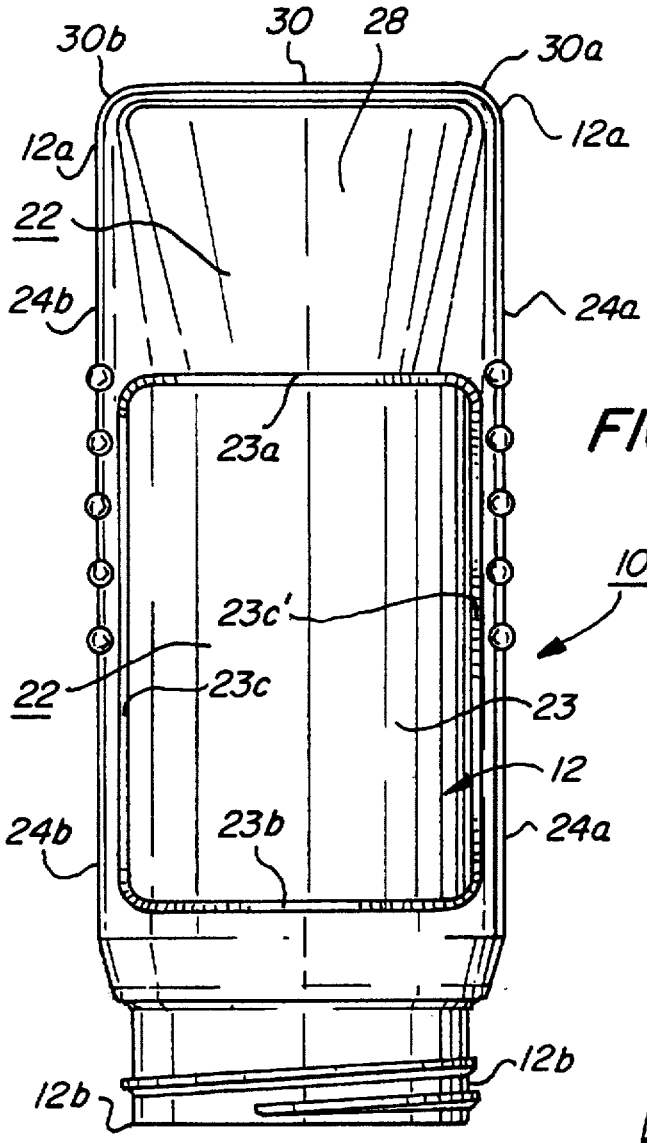
FIG. 1D is an elevation rear view of the applicator-container of FIG. 1.

Referring now to FIGS. 1–1D inclusively, there is shown an applicator-container 10 comprising a container body 12 defining an interior 14 (FIG. 1C) within which any suitable material, such as a flowable paste material may be stored. The material to be stored within container body 12 will typically comprise a caulking compound, a sealing compound, a patching compound or any such material. Such materials are typically of a paste-like consistency and are "flowable", at least in the sense that they can be shaped and smoothed by moderate pressure and will retain such shaped and smoothed configuration as they cure or dry to a hardened or non-flowable condition. The applicator means provided by applicator-container 10 is well-adapted to smoothing and filling cavities in a surface or workpiece and otherwise working and shaping a material such as a caulking compound, putty, etc.

Container body 12 has a first end 12*a* and an opposite, second end 12*b*. A container mouth 16 is formed at second end 12*b* to provide access to interior 14 for filling the applicator-container 10 and thereafter withdrawing material from it for use. A seating means comprises, in the illustrated embodiment, a conventional thread structure 18 disposed circumferentially about container mouth 16.

Container body 12 has a front face 20 (FIG. 1B) defining essentially the entire front panel of container 12 and a rear face 22 defining substantially the entire back panel of container body 12. Front face 20 has formed thereon a raised, front label billboard 21 having a top edge 21*a*, a bottom edge 21*b* and opposite side edges 21*c* and 21*c'*. Correspondingly, rear face 22 has formed thereon a raised, rear label billboard 23 having a top edge 23*a*, a bottom edge 23*b* and opposite side edges 23*c* and 23*c'*. Front face 20 and rear face 22 are separated by side panels 24*a*, 24*b*, each of which defines substantially the entirety of one of the side panels of container body 12. Grip-enhancing formations comprising, in the illustrated embodiment, a plurality of rib formations 26*a*, 26*b* are formed on, respectively, side panels 24*a* and 24*b*. As seen in FIG. 1, the depth of container body 12 along any point thereof is defined by the shortest straight line distance between front face 20 and rear face 22. The depth at two locations along the longitudinal axis of container body 12 is indicated in FIG. 1 by dimension lines d and d'.

An applicator blade surface 28 (FIGS. 1, 1A and 1D) is provided by a rear tapered portion of rear face 22. Applicator blade surface 28 terminates in a straight edge 30 (FIGS. 1 and 1D). As best seen in FIG. 1D, in the illustrated embodiment, straight edge 30 terminates at either end thereof in rounded, corner portions 30*a*, 30*b*. It will be noted that applicator blade surface 28, which comprises a smooth surface, and straight edge 30 together simulate the shape of a conventional putty knife blade.

Referring now to FIG. 1B, container body 12 is seen to further have a front tapered portion 32 which extends from top edge 21*a* of front label billboard 21 to first end 12*a* of container body 12. A finger rest 32*a* is formed on front tapered portion 32. Finger rest 32*a* may comprise a recess or a knurled upwardly curving member or any other formation which provides a stop or rest for the operator's finger. Thus, in the illustrated embodiment, finger rest 32*a* comprises a triangular, raised border 32*b* which projects upwardly from the surface of front tapered portion 32.

Figure 2A:
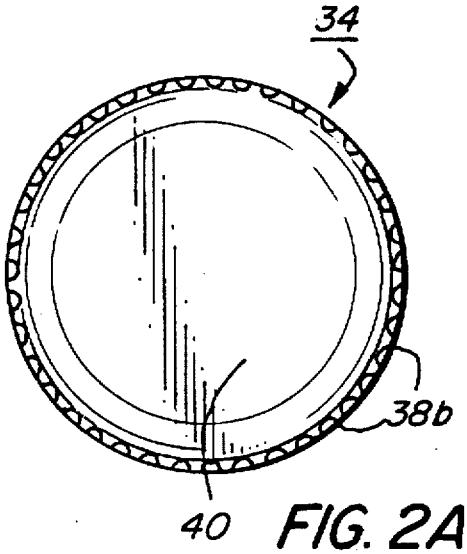
FIG. 2A is a plan view of the threaded cap of FIG. 2, taken along line 2A—2A of FIG. 2.
Figure 2:
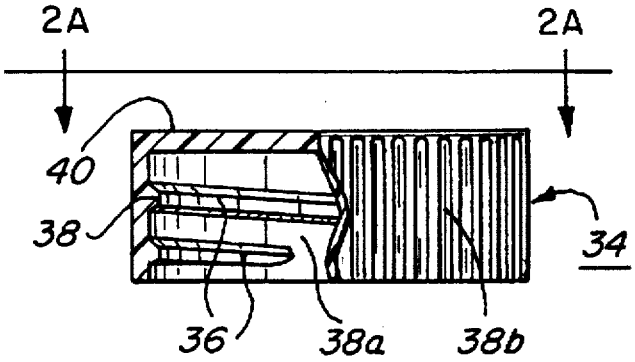
FIG. 2 is a side elevation view, with part broken away, of a screw-on threaded cap comprising one embodiment of a closure means of the applicator-container of FIGS. 1–1D.

Referring now to FIGS. 2 and 2A, a closure means is provided in the illustrated embodiment by a conventional threaded cap 34 which has a cap thread 36 (FIG. 2) formed on the interior surface 38*a* of side skirt 38, a knurled outer surface 38*b* of side skirt 38, and a flat crown 40. Threaded cap 34 may be threaded upon thread structure 18 formed at the second end 12*b* of container body 12 to close the container mouth 16 and thereby seal the interior 14. The flat crown 40 of threaded cap 34 enables applicator-container 10 to stand vertically when cap 34 is in place, flat crown 40 providing a stable base for the applicator-container.

Applicator-container 10 may be made of any suitable material and by any suitable method. An efficient method is to mold container body 12 as a one-piece integral member, for example, by injection-molding a suitable plastic material. Applicator-container 10 is filled with a suitable flowable paste material through container mouth 16 which is then sealed by threaded cap 34.

In use, threaded cap 34 is removed and a portion of the flowable paste material, such as a caulking compound, putty, sealant or the like, is removed from the interior 14 and applied to a groove, cavity or surface into or onto which the flowable paste material is to be applied. The user's finger or a simple tool such as a screwdriver tip, knife blade or stick may conveniently be used to dispense a portion of the flowable paste material, or the paste material may simply be allowed to flow out of the container mouth onto the surface or object to which the material is to be applied. Alternatively, an applicator tongue or blade (not shown) may be formed on the interior of threaded cap 34 to provide a tool for removing flowable paste material from applicator-container 10 and making a rough application of the material to the workpiece or surface being treated. Threaded cap 34 is then screwed back onto thread structure 18 to seal the interior 14 of applicator-container 10.

After replacing threaded cap 34 by screwing it onto thread structure 18, the operator grasps applicator-container 10 with, in the case of using the right hand, the thumb positioned over rib formations 26*a* of side panel 24*a*, the tip of the first finger seated within finger rest 32*a*, and the remaining fingers curled around rib formation 26*b* of side panel 24*b*. When using the left hand, the thumb will be positioned over rib formations 26*b* of side panel 24*b*, the tip of the first finger within finger rest 32*a*, and the remaining fingers curled around rib formations 26*a* of side panel 24*a*. The user then manipulates applicator-container 10 to utilize applicator blade surface 28 and straight edge 30 in the same manner as one would employ a conventional putty knife to smooth and shape the deposited flowable paste material.

While the invention has been described in connection with a specific preferred embodiment thereof, it will be appreciated that numerous variations may be made to the disclosed specific embodiment which nonetheless lie within the scope of the appended claims.

What is claimed is:

1. An applicator-container comprising:

a container body having a front face and a rear face spaced apart from each other to define therebetween an interior for containing a flowable paste material and further having a container mouth formed therein, the rear face having a rear tapered portion defined by spaced-apart facing portions of the front face and the rear face;

seating means on the applicator-container dimensioned and configured to receive a closure means for selectively (a) closing the container mouth to seal the interior and (b) opening the container mouth to enable dispensing such flowable material therethrough; and applicator means consisting of the rear tapered portion of the container body defined by the spaced-apart facing portions of the front face and the rear face and configured as an applicator blade surface terminating in a straight edge formed by the intersection of the facing portions.

2. The applicator-container of claim 1 wherein the container body has opposite first and second ends and the applicator means is at the first end and the container mouth is at the second end.

3. The applicator-container of claim 1 including the closure means seated on the seating means to close the container mouth.

4. The applicator-container of claim 3 wherein the seating means comprises a thread structure disposed adjacent the container mouth and the closure means comprises a threaded cap.

5. The applicator-container of claim 1 wherein the front and rear faces are separated by a pair of opposite side panels whereby the container body has a depth defined by the shortest straight line distance between the front face and the rear face, the container body further has respective first and second ends and the rear tapered portion is dimensioned and configured to reduce the depth of the container body as sensed moving along the container body towards the first end.

6. The applicator-container of claim 5 wherein the container body further has a front tapered portion which extends along at least a part of the front face and cooperates with the rear tapered portion to reduce the depth of the container body as sensed moving along the container body towards the first end.

7. The applicator-container of claim 6 wherein a finger rest is formed on the front tapered portion.

8. The applicator-container of claim 5 wherein the side panels have grip-enhancing formations thereon.

9. The applicator-container of claim 5 wherein the applicator blade surface comprises a smooth surface which terminates in the straight edge.

10. The applicator-container of claim 6 wherein the side panels have grip-enhancing formations thereon.

11. The applicator-container of claim 6 wherein the applicator blade surface comprises a smooth surface which terminates in the straight edge.

* * * * *

UNITED STATES PATENT AND TRADEMARK OFFICE

CERTIFICATE OF CORRECTION

PATENT NO : 5,800,144

DATED : September 1, 1998

INVENTOR(S) : William C. Glenn et al

It is certified that error appears in the above-identified patent and that said Letters Patent is hereby corrected as shown below:

In Figure 1C of the drawings attach lead lines to the reference numeral 16 as shown below.

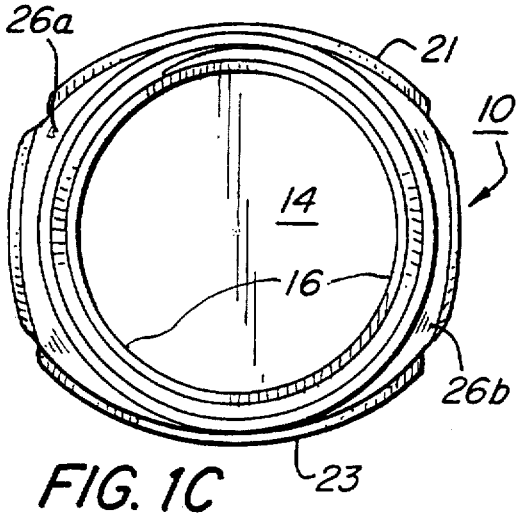

FIG. 1C

UNITED STATES PATENT AND TRADEMARK OFFICE

CERTIFICATE OF CORRECTION

PATENT NO : 5,800,144

DATED : September 1, 1998

INVENTOR(S) : William C. Glenn et al

It is certified that error appears in the above-identified patent and that said Letters Patent is hereby corrected as shown below:

On the title page:

Replace the title "APPLICATOR CONTAINER" with --APPLICATOR-CONTAINER--;

In line 8 of the Abstract, replace "30" with --(30)--.

In column 1, line 1, replace the title "APPLICATOR CONTAINER" with --APPICATOR-CONTAINER--;

In column 2, line 19, replace "thread" with --threaded--;

In column 3, lines 20 and 67, replace "thread" with --threaded--.

In column 4, lines 28 and 30, replace "thread" with --threaded--.

In column 5, line 2 of claim 4, replace "thread" with --threaded--.

Signed and Sealed this

Thirty-first Day of August, 1999

*Attest:*

Q. TODD DICKINSON

*Attesting Officer*

*Acting Commissioner of Patents and Trademarks*